US008070192B2

(12) United States Patent
Tien

(10) Patent No.: US 8,070,192 B2
(45) Date of Patent: Dec. 6, 2011

(54) DOGGING DEVICE FOR LATCH ASSEMBLY

(75) Inventor: Hung-Jen Tien, Tainan (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 927 days.

(21) Appl. No.: 11/968,731

(22) Filed: Jan. 3, 2008

(65) Prior Publication Data

US 2009/0174194 A1 Jul. 9, 2009

(51) Int. Cl.
*E05B 65/10* (2006.01)
*E05B 65/00* (2006.01)

(52) U.S. Cl. ..... 292/92; 292/DIG. 65; 70/92

(58) Field of Classification Search ..... 292/92–94, 292/DIG. 65; 70/92
See application file for complete search history.

(56) References Cited

U.S. PATENT DOCUMENTS 3,374,021 A * 3/1968 Gulette ..... 292/336.3
3,614,145 A * 10/1971 Zawadzki ..... 292/92
3,767,238 A * 10/1973 Zawadzki ..... 292/21
4,624,490 A * 11/1986 Miller ..... 292/92
5,927,765 A 7/1999 Austin et al.
6,009,732 A * 1/2000 Haeck et al. ..... 70/92
6,205,825 B1 * 3/2001 Haeck et al. ..... 70/92
6,532,777 B2 * 3/2003 Haeck et al. ..... 70/92
6,769,723 B2 * 8/2004 Cohrs et al. ..... 292/92
6,820,905 B1 * 11/2004 Haeck et al. ..... 292/93
7,000,954 B2 * 2/2006 Cohrs et al. ..... 292/92

* cited by examiner

*Primary Examiner* — Carlos Lugo
*Assistant Examiner* — Alyson M Merlino
(74) *Attorney, Agent, or Firm* — Alan Kamrath; Kamrath & Associates PA

(57) ABSTRACT

A dogging device includes a base mounted in a housing of a latch assembly. The base includes a hole through which a shaft rotatably extends. A limiting keyway extends from the hole and receives and limits rotation of a shaft key on the shaft. A dogging member includes a through-hole receiving the shaft. A keyway extends from the through-hole and receives the shaft key of the shaft, allowing joint rotation of the shaft and the dogging member. By engaging a tool with a driving groove in an end of the shaft or by utilizing a lock core key to turn a lock core that directly pivots the dogging member, the dogging member is pivotable between a first position engaged with a latching/unlatching control rod of the latch assembly to lock a latch bolt in a retracted state and a second position disengaged from the latching/unlatching control rod.

14 Claims, 9 Drawing Sheets

DOGGING DEVICE FOR LATCH ASSEMBLY

BACKGROUND OF THE INVENTION

The present invention relates to a dogging device for a latch assembly and, more particularly, to a dogging device for a latch assembly for a panic exit door.

A panic exit door or a frequently opened/closed door generally includes a latch assembly having a latch bolt and a dogging device for locking the latch bolt in a retracted position to allow convenient access/exit through the door. U.S. Pat. No. 5,927,765 discloses a dogging device including a dogging adapter having a cylindrical body with an axial opening through which a dogging plate extends. The dogging hook is engaged with the dogging adapter and pivotable about an axis between a first position engaging a latching and unlatching control rod of the latch assembly and a second position not engaging the latching and unlatching control rod. An operator is coaxial with the dogging hook axis and engages with the dogging adaptor. A biasing spring biases the dogging hook in either of the first or second positions. A U-shaped spring clip axially retains the dogging adapter, the operator, and the dogging hook. The operator is a hex shaft or a locking cylinder one of which can be driven by a hex Allen wrench or a key. Such a dogging device allows easy field conversion from hex dogging to cylinder dogging. During the field conversion, an endcap and a coverplate of the latch assembly are first removed, and the hex shaft is pulled straight out. The cylinder adapter is then pressed over the U-shaped spring clip. The endcap is replaced along with a coverplate having a locking and unlocking device installed in the coverplate. However, several detaching procedures are still required for replacement, and it is still possible to assemble the dogging device incorrectly and, thus, renders the dogging device inoperable. Furthermore, such a dogging device is too complicated and expensive.

A need exists for a simple dogging device that can be operated by a toot or a key without the need of replacement elements.

BRIEF SUMMARY OF THE INVENTION

The present invention solves this need and other problems in the field of dogging devices by providing, in a preferred form, a dogging device including a base adapted to be mounted in a housing of a latch assembly. The base includes a first end, a second end, and an intermediate section between the first and second ends. The intermediate section has a hole and a limiting keyway extending from the hole. A shaft rotatably extends through the hole of the base and includes a shaft key formed on an outer periphery thereof. The limiting keyway of the base receives and limits rotation of the shaft key. The shaft further includes a driving groove in an end thereof. The driving groove is adapted to be engaged with and driven by a tool. A dogging member includes a first end, a second end, and an intermediate portion between the first and second ends of the dogging member. The intermediate portion of the dogging member includes a through-hole receiving the shaft. A keyway extends from the through-hole and receives the shaft key of the shaft, allowing joint rotation of the shaft and the dogging member. The first end of the dogging member includes an arm adapted to be actuated by an actuating portion of a lock core mounted in the housing of the latch assembly such that the dogging member is rotated when the lock core is turned by a lock core key. Thus, by turning the shaft with the tool or by turning the lock core with the lock core key, the second end of the dogging member is pivotable between a first position adapted to engage with a latching/unlatching control rod of the latch assembly and a second position adapted to disengage from the latching/unlatching control rod of the latch assembly. A spring is mounted between the base and the dogging member to bias the dogging member in one of the first and second positions.

In the most preferred form, the intermediate section of the base is substantially U-shaped and has two spaced arm portions from which the first and second ends of the base extend away from each other. A compartment is defined between the two arm portions and receives the other end of the shaft. The other end of the shaft includes a flange having an outer diameter larger than a diameter of the hole of the base. The shaft key is formed on the flange.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
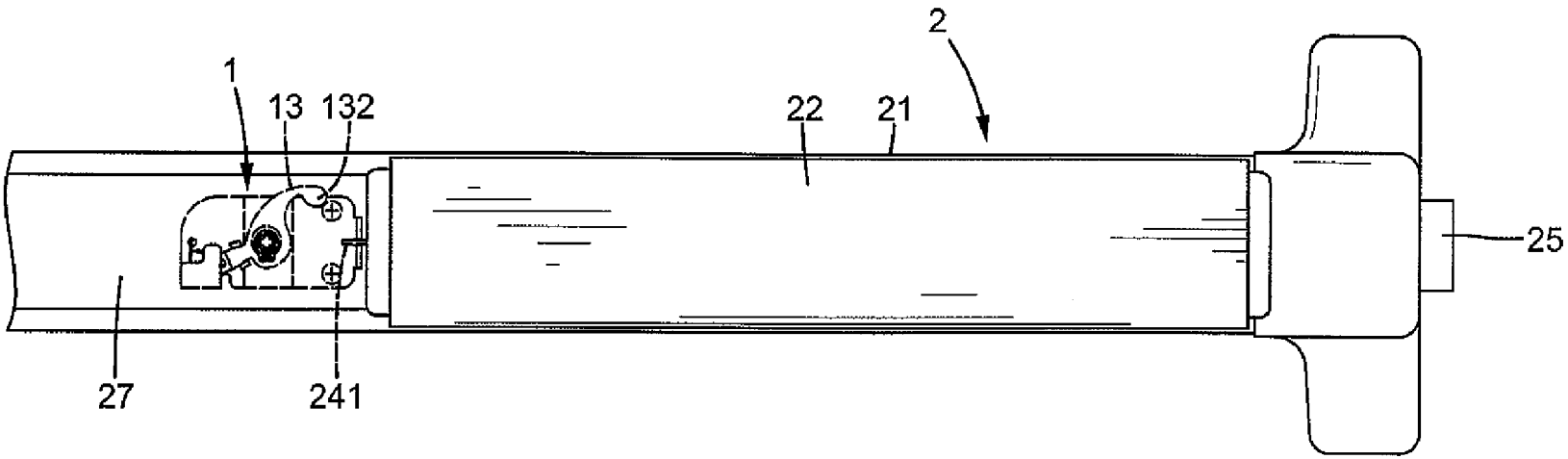
FIG. 1 shows a diagrammatic side view of a latch assembly utilizing a dogging device according to the preferred teachings of the present invention with a dogging member of the dogging device in a disengaging position disengaged from a latching/unlatching control rod of the latch assembly.
Figure 2:
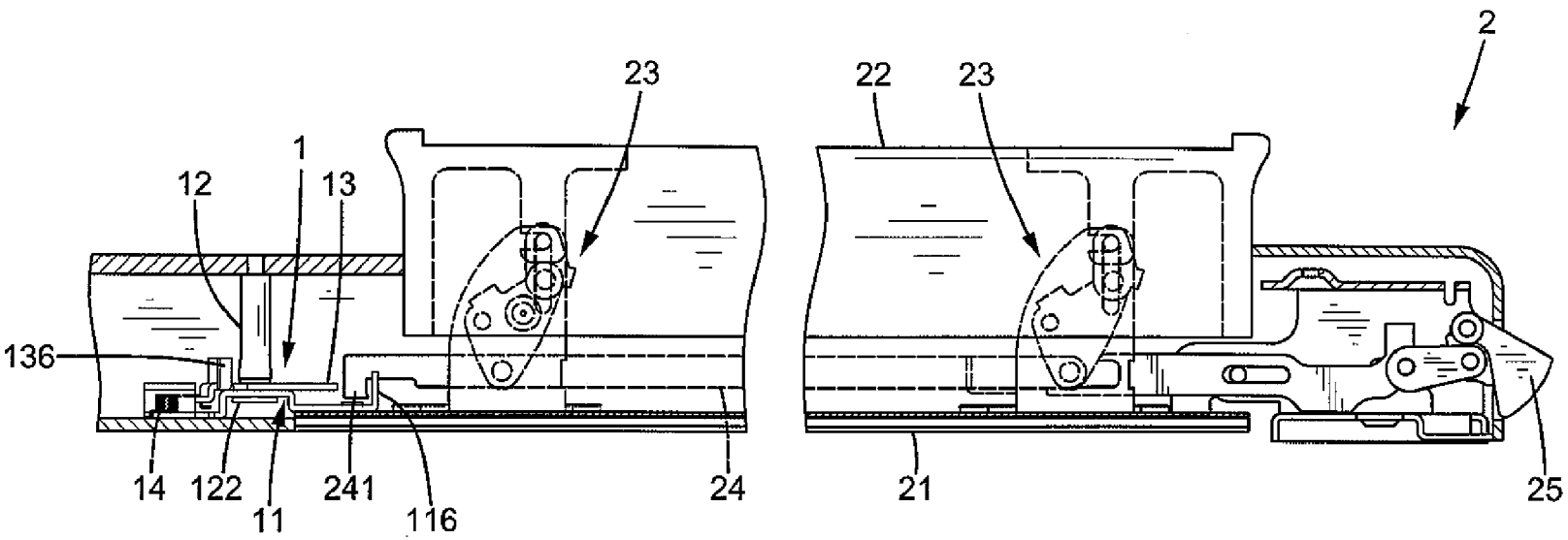
FIG. 2 shows a partial, cross-sectional view of the latch assembly and the dogging device of FIG. 1 with the dogging member in the disengaging position disengaged from the latching/unlatching control rod.
Figure 3:
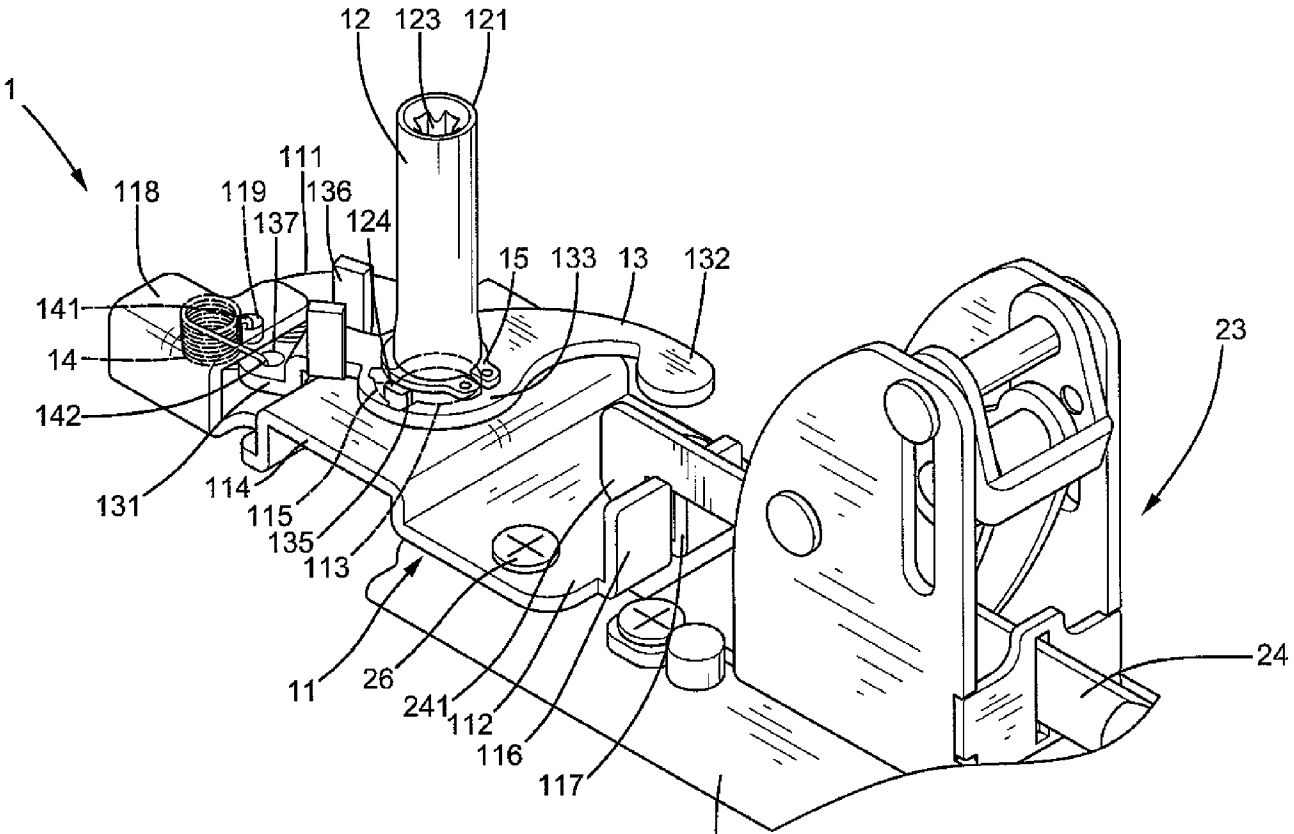
FIG. 3 shows a partial perspective view of the latch assembly and the dogging device of FIG. 1 with the dogging member in the disengaging position disengaged from the latching/unlatching control rod.
Figure 4:
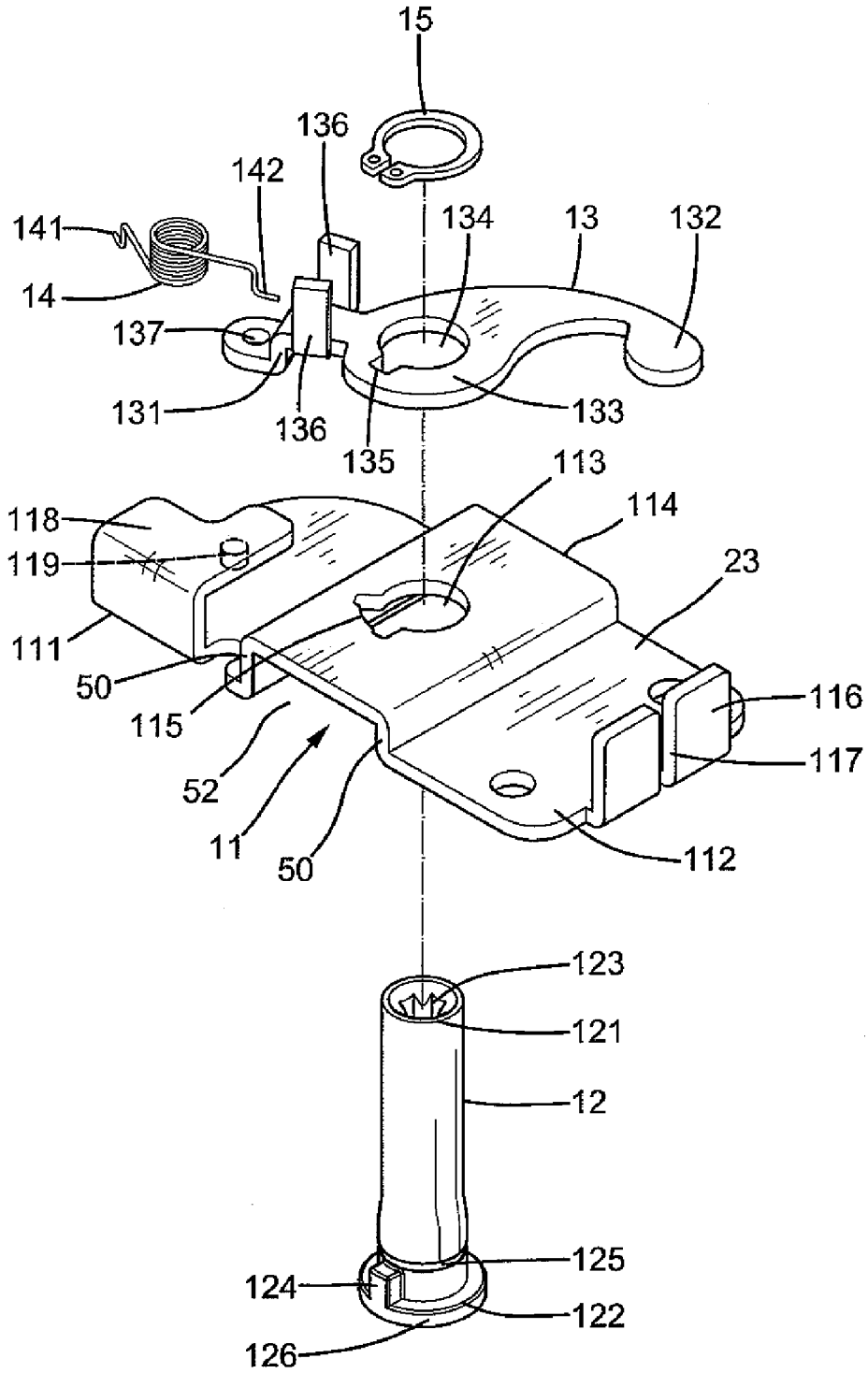
FIG. 4 shows an exploded perspective view of the dogging device of FIG. 1.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "end", "portion", "section", "axial", "outward", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

Figure 5:
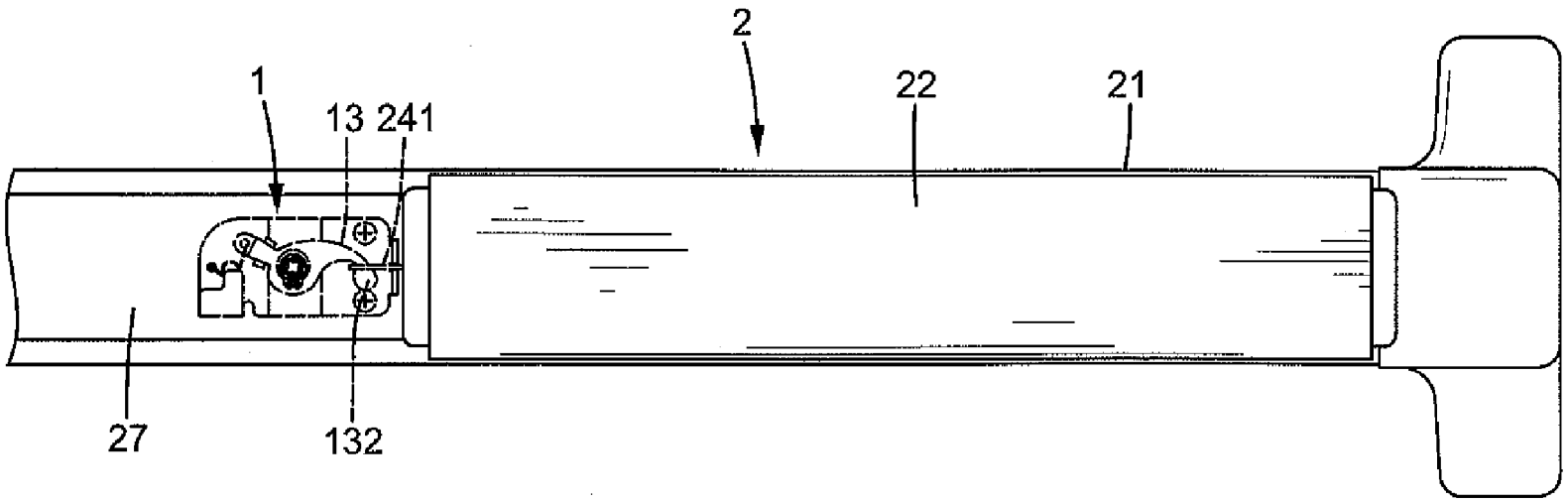
FIG. 5 shows a side view of the latch assembly and the dogging device of FIG. 1 with the dogging member in an engaging position engaged with the latching/unlatching control rod.
Figure 6:
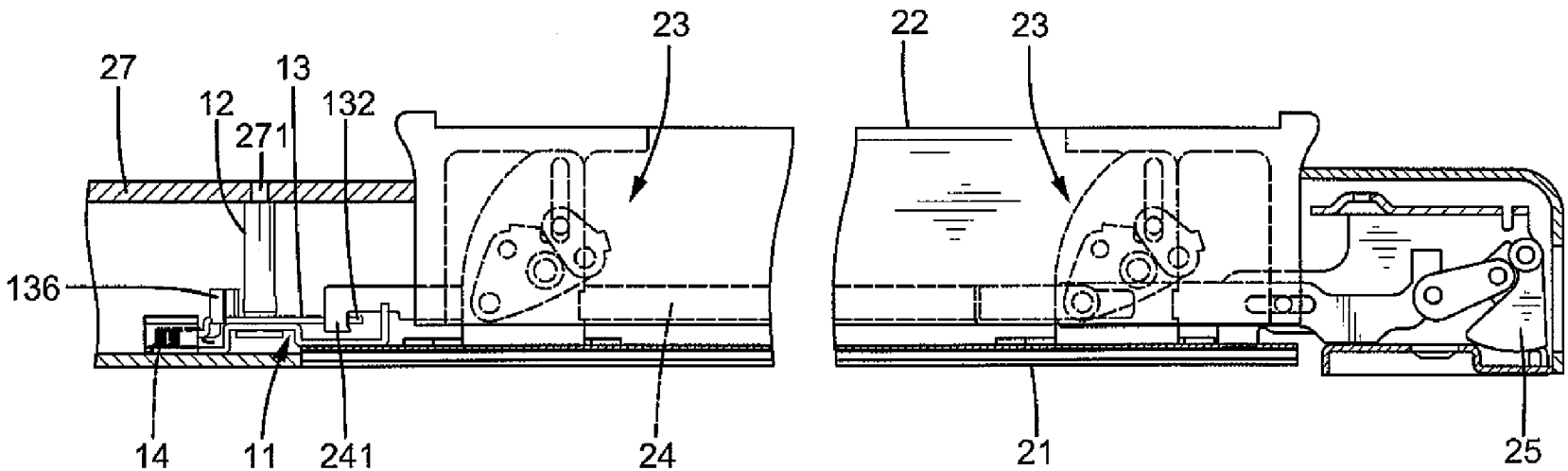
FIG. 6 shows a partial, cross-sectional view of the latch assembly and the dogging device of FIG. 1 with the dogging member in the engaging position engaged with the latching/unlatching control rod.
Figure 7:
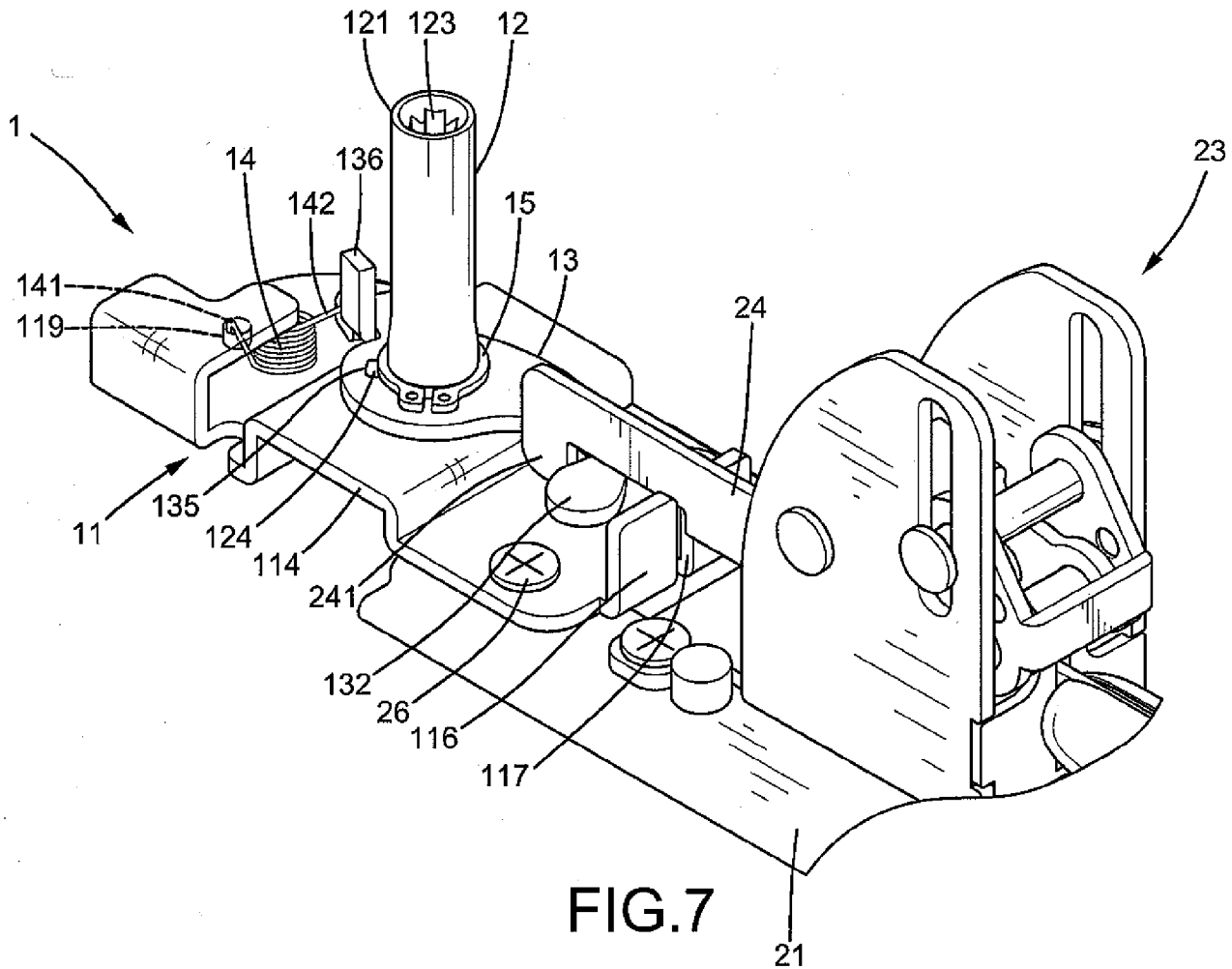
FIG. 7 shows a partial, perspective view of the latch assembly and the dogging device of FIG. 1 with the dogging member in the engaging position engaged with the latching/unlatching control rod.
Figure 8:
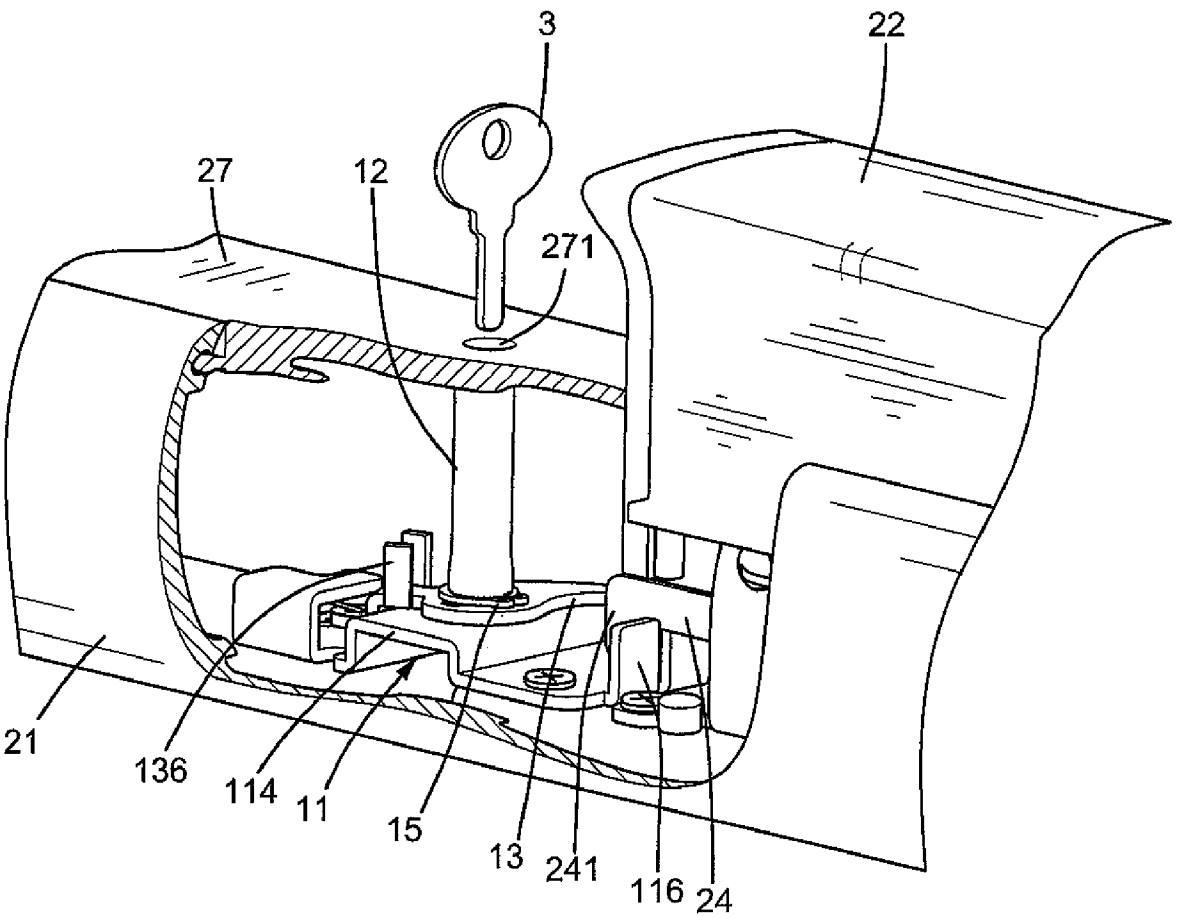
FIG. 8 shows a partial, perspective view of the latch assembly and the dogging device of FIG. 1 with a cover plate of a type mounted to the latch assembly.

A dogging device according to the preferred teachings of the present invention is shown in the drawings and generally designated 1. The dogging device 1 can be utilized with a latch assembly 2 mounted to a door such as a panic exit door. According to the preferred form shown, the latch assembly 2 includes a housing 21, a latch bolt 25, a latching/unlatching control rod 24 operably connected to the latch bolt 25, a pair of transmission mechanisms 23 coupled with the latching/unlatching control rod 24, and an active bar 22 coupled with the transmission mechanisms 23. When the active bar 22 is depressed, the latch bolt 25 is retracted into the housing 21 through transmission by the transmission mechanisms 23 and the latching/unlatching control rod 24 (FIGS. 5 and 6), allowing access/exit through the door. The housing 21 can include a cover plate 27 with a through-hole 271 (FIG. 8) or a cover plate 27' with a lock core 41 mounted therein. The cover plates 27 and 27' are exchangeable according to needs. It can be appreciated that the dogging device 1 according to the preferred teachings of the present invention can be utilized with other types of latch assemblies 2 mounted to various doors.

According to the preferred form shown, the dogging device 1 includes a base 11 fixed by fasteners 26 in the housing 21 of the latch assembly 2 in a location adjacent an end 241 of the latching/unlatching control rod 24 that is distal to the latch bolt 25. The base 11 includes a first end 111, a second end 112, and a substantially U-shaped intermediate section 114 between the first and second ends 111 and 112. The U-shaped intermediate section 114 includes two arm portions 50 from which the first and second ends 111 and 112 extend away from each other. A compartment 52 is defined between the arm portions 50. The U-shaped intermediate section 114 further includes a hole 113 in a main portion between the arm portions 50. A limiting keyway 115 extends outward from the hole 113. The first end 111 of the base 11 includes a bend 118 having a positioning hole 119. The second end 112 of the base 11 includes two spaced guides 116 extending from and perpendicular to the second end 112 of the base 11. The guides 116 have a passageway 117 therebetween through which the end 241 of the latching/unlatching control rod 24 extends.

According to the preferred form shown, a shaft 12 is rotatably extended through the hole 113 of the base 1. The shaft 12 includes a first end 121 and a second end 122. A driving groove 123 is defined in the first end 121 of the shaft 12. A tool 3 (FIG. 8) can be inserted into the driving groove 123 to rotate the shaft 12. The second end 132 of the dogging member 13 is, thus, pivotable between an engaging position for engaging with the latching/unlatching control rod 24 of the latch assembly 2 and a disengaging position disengaged from the latching/unlatching control rod 24 of the latch assembly 2 upon rotation of the tool 3. The second end 122 of the shaft 12 is received in the compartment 52 of the base 11 and includes a flange 126 having an outer diameter larger than a diameter of the hole 113 of the base 11. A shaft key 124 is formed on the flange 126. The limiting keyway 115 of the base 11 receives and limits rotation of the shaft key 124. The shaft 12 further includes an annular groove 125.

According to the preferred form shown, the dogging device 1 further includes a dogging member 13 having a first end, 131, a second end 132 in the most preferred form shown as a hook, and an intermediate portion 133 between the first and second ends 131 and 132 of the dogging member 13. The intermediate portion 133 of the dogging member 13 includes a through-hole 134 receiving the shaft 12. A keyway 135 extends outward from the through-hole 134 and receives the shaft key 124 of the shaft 12, allowing joint rotation of the shaft 12 and the dogging member 13. The first end 131 of the dogging member 13 includes a pair of spaced, opposite arms 136 one of which can be actuated by an actuating portion 411 of the lock core 41 (FIG. 9) mounted in the housing 21 of the latch assembly 2. Specifically, the dogging member 13 is rotated when a lock core key 4 is inserted into the lock core 41 and drives the lock core 41 to turn. The second end 132 of the dogging member 13 is, thus, pivotable between the engaging position for engaging with the latching/unlatching control rod 24 and the disengaging position disengaged from the latching/unlatching control rod 24 upon rotation of the lock core key 4. The first end 131 of the dogging member 13 further includes a positioning hole 137.

It can be appreciated that the annular groove 125 and the flange 126 of the shaft 12 are on opposite sides of the intermediate section 114 of the base 11. After mounting the dogging member 13 around the shaft 12, a retainer 15 is engaged in the annular groove 125 of the shaft 12 to axially retain the shaft 12 and the dogging member 13.

According to the preferred form shown, a spring 14 is mounted between the base 11 and the dogging member 13 to bias the dogging member 13 in one of the engaging and disengaging positions. The spring 14 is a torsion spring having a first tang 141 fixed in the positioning hole 119 of the first end 111 of the base 11 and a second tang 142 fixed in the positioning hole 137 of the first end 131 of the dogging member 13.

Now that the basic construction of the dogging device 1 of the preferred teachings of the present invention has been explained, the operation and some of the advantages of the dogging device 1 can be set forth and appreciated. In a case that the dogging device 1 according to the preferred teachings of the present invention is utilized with a latch assembly 2 including a housing 21 having a cover plate 27 shown in FIG. 8, the driving groove 123 of the shaft 12 is aligned with the through-hole 271 of the cover plate 27. The active bar 22 is depressed to move the end 241 of the latching/unlatching control rod 24 toward the dogging member 13, and the latch bolt 25 is retracted. A tool 3 can be inserted through the through-hole 271 into the driving groove 123 and rotated through an angle to move the second end 132 of the dogging member 13 to the engaging position to securely engage with the end 241 of the latching/unlatching control rod 24. The latch bolt 25 is, thus, retained in the retracted, unlatching position whereas the active bar 22 is retained in the depressed state. The latch bolt 25 can be freed by turning the tool 3 in a reverse direction to move the second end 132 of the dogging member 13 to the disengaging position disengaged from the end 241 of the latching/unlatching control rod 24.

Figure 9:
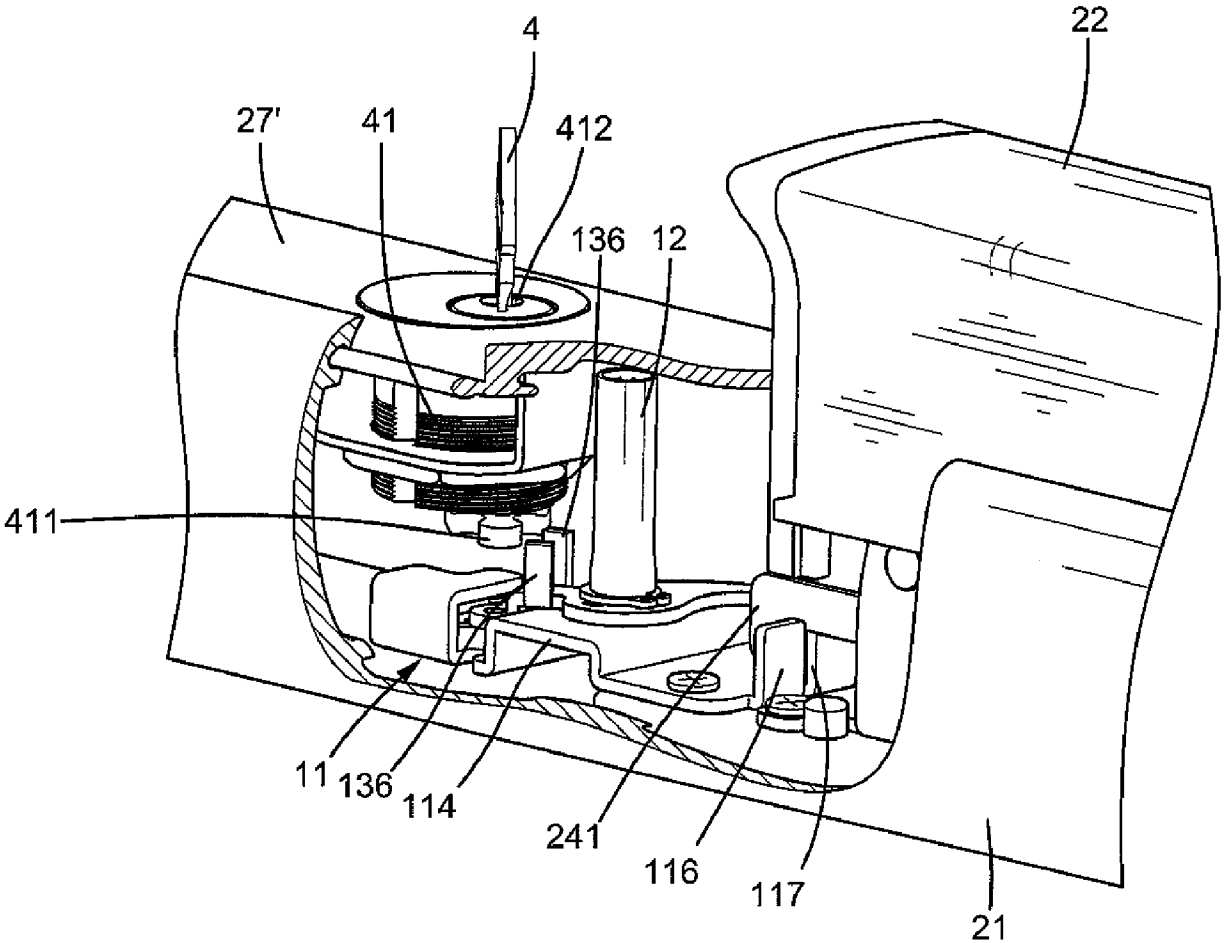
FIG. 9 shows a partial, perspective view of the latch assembly and the dogging device of FIG. 1 with a cover plate of another type mounted to the latch assembly.

In another case that the dogging device 1 according to the preferred teachings of the present invention is utilized with a latch assembly 2 including a housing 21 having a cover plate 27' shown in FIG. 9, the actuating portion 411 of the lock core 41 is adjacent to the arms 136 of the dogging member 13. The active bar 22 is depressed to move the end 241 of the latching/unlatching control rod 24 toward the dogging member 13, and the latch bolt 25 is retracted. A lock core key 4 can be inserted through the keyhole 412 and rotated through an angle to actuate one of the arms 136 of the dogging member 13. The second end 132 of the dogging member 13 is moved to the engaging position securely engaged with the end 241 of the latching/unlatching control rod 24. The latch bolt 25 is, thus, retained in the retracted, unlatching position whereas the active bar 22 is retained in the depressed state. The latch bolt 25 can be freed by turning the lock core key 4 in a reverse direction to move the second end 132 of the dogging member 13 to the disengaging position disengaged from the end 241 of the latching/unlatching control rod 24.

Thus, the dogging device 1 according to the preferred teachings of the present invention can be utilized with different cover plates 27, 27' with either a simple through-hole 271 or a lock core 41 without the need of replacement of elements of the dogging device 1 according to the preferred teachings of the present invention.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A dogging device for a latch assembly comprising:

a base mounted in a housing for a latch assembly;

a first cover plate having a through-hole;

a second cover plate, with a lock core mounted to the second cover plate and including an actuating portion, with the base including a first end, a second end, and an intermediate section between the first and second ends, with the intermediate section having a hole extending through the base along a longitudinal axis and a limiting keyway in the base extending from the hole along a radial direction perpendicular to the longitudinal axis;

a shaft rotatably extending through the hole of the base along the longitudinal axis, with the shaft including a shaft key formed on an outer periphery thereof, with the limiting keyway of the base receiving and limiting rotation of the shaft key, with the shaft further including a driving groove in an end thereof, with the driving groove being adapted to be engaged with and driven by a tool;

a dogging member including a first end, a second end, and an intermediate portion between the first and second ends of the dogging member, with the intermediate portion of the dogging member including a through-hole receiving the shaft, with a keyway extending from the through-hole and receiving the shaft key of the shaft, allowing joint rotation of the shaft and the dogging member, with the first end of the dogging member including at least one arm extending perpendicularly from the first end of the dogging member and spaced from and parallel to the longitudinal axis, with the housing being alternately mounted to the first cover plate and the second cover plate, with the at least one arm actuated by the actuating portion of the lock core mounted in the second cover plate, with the dogging member rotated when the housing is mounted to the second cover plate and when the lock core is turned by a lock core key different from the tool, with the second end of the dogging member being pivotable between a first position adapted to engage with a latching/unlatching control rod of the latch assembly and a second position adapted to disengage from the latching/unlatching control rod of the latch assembly by turning the shaft with the tool or by turning the lock core with the lock core key; and a spring mounted between the base and the dogging member to bias the dogging member in one of the first and second positions, wherein with the housing mounted to the first cover plate, the driving groove of the shaft is aligned with the through-hole of the first cover plate, the second end of the dogging member is moveable to the first position by turning the tool extending through the through-hole of the first cover plate into the driving groove of the shaft.

wherein with the housing mounted to the second cover plate, the second end of the dogging member is moveable to the first position by turning the lock core with the lock core key to actuate the at least one arm of the dogging member.

2. The dogging device for a latch assembly as claimed in claim 1, with the intermediate section of the base being substantially U-shaped and having two spaced arm portions from which the first and second ends of the base extend away from each other, with the two spaced arm portions parallel to and facing each other, with a compartment being defined between the two spaced arm portions, with the shaft including another end received in the compartment, with the other end of the shaft including a flange having an outer diameter larger than a diameter of the hole of the base, and with the shaft key being formed on the flange.

3. The dogging device for a latch assembly as claimed in claim 2, with the shaft further including an annular groove, with the annular groove and the flange being on opposite sides of the intermediate section of the base, and with the dogging device further comprising: a retainer engaged in the annular groove to axially retain the shaft and the dogging member, with the retainer located between the dogging member and the end of the shaft having the driving groove.

4. The dogging device for a latch assembly as claimed in claim 1, with the second end of the dogging member being a hook, with the hook being movable to the first position to securely engage with the latching/unlatching control rod by engaging the tool with the driving groove or by rotating the lock core with the lock core key, thereby locking a latch bolt connected to the latching/unlatching control rod in a retracted, unlatching position.

5. The dogging device for a latch assembly as claimed in claim 1, with the second end of the base including two spaced guides extending from and perpendicular to the second end of the base, with the two guides having a passageway therebetween through which the latching/unlatching control rod extends.

6. The dogging device for a latch assembly as claimed in claim 1, with the first end of the base including a bend with a first positioning hole, with the first end of the dogging member including a second positioning hole, with each of the first and second positioning holes extending in a direction parallel to and spaced from the longitudinal axis, with the spring being a torsion spring having a first tang fixed in the first positioning hole and a second tang fixed in the second positioning hole.

7. The dogging device for a latch assembly as claimed in claim 1, with the at least one arm of the dogging member including two arms located opposite to one another, and with one of the two arms being actuated by the actuating portion of the lock core when the lock core is rotated by the lock core key.

8. An assembly for a latch assembly comprising, in combination:

a first cover plate having a through-hole;

a second cover plate, with a lock core mounted to the second cover plate and including an actuating portion;

a base mounted in a housing, with the base including a first end, a second end, and an intermediate section between the first and second ends, with the intermediate section having a hole extending through the base along a longitudinal axis and a limiting keyway extending from the hole along a radial direction perpendicular to the longitudinal axis;

a shaft rotatably extending through the hole of the base along the longitudinal axis, with the shaft including a shaft key formed on an outer periphery thereof, with the limiting keyway of the base receiving and limiting rotation of the shaft key, with the shaft further including a driving groove in an end thereof, with the driving groove being adapted to be engaged with and driven by a tool;

a dogging member including a first end, a second end, and an intermediate portion between the first and second ends of the dogging member, with the intermediate portion of the dogging member including a through-hole receiving the shaft, with a keyway extending from the through-hole and receiving the shaft key of the shaft, allowing joint rotation of the shaft and the dogging member, with the first end of the dogging member including at least one arm extending perpendicularly from the first end of the dogging member and spaced from and parallel to the longitudinal axis, with the housing being alternately mounted to the first cover plate and the second cover plate with the at least one arm actuated by the actuating portion of the lock core mounted in the second cover plate such that the dogging member is rotated when the housing is mounted to the second cover plate and when the lock core is turned by a lock core key different from the tool, with the second end of the dogging member being pivotable between a first position adapted to engage with a latching/unlatching control rod of the latch assembly and a second position adapted to disengage from the latching/unlatching control rod of the latch assembly by turning the shaft with the tool or by turning the lock core with the lock core key; and a spring mounted between the base and the dogging member to bias the dogging member in one of the first and second positions, wherein with the housing mounted to the first cover plate, the driving groove of the shaft is aligned with the through-hole of the first cover plate, the second end of the dogging member is moveable to the first position by turning the tool extending through the through-hole of the first cover plate into the driving groove of the shaft, wherein with the housing mounted to the second cover plate, the second end of the dogging member is moveable to the first position by turning the lock core with the lock core key to actuate the at least one arm of the dogging member.

9. The assembly for a latch assembly as claimed in claim 8, with the intermediate section of the base being substantially U-shaped and having two spaced arm portions from which the first and second ends of the base extend away from each other, with the two arms parallel to and facing each other, with a compartment being defined between the two arm portions, with the shaft including another end received in the compartment, with the other end of the shaft including a flange having an outer diameter larger than a diameter of the hole of the base, and with the shaft key being formed on the flange.

10. The assembly for a latch assembly as claimed in claim 9, with the shaft further including an annular groove, with the annular groove and the flange being on opposite sides of the intermediate section of the base, and with the assembly further comprising: a retainer engaged in the annular groove to axially retain the shaft and the dogging member, with the retainer located between the dogging member and the end of the shaft having the driving groove.

11. The assembly for a latch assembly as claimed in claim 10, with the second end of the dogging member being a hook, with the hook being movable to the first position to securely engage with the latching/unlatching control rod by engaging the tool with the driving groove or by rotating the lock core with the lock core key, thereby locking a latch bolt connected to the latching/unlatching control rod in a retracted, unlatching position.

12. The assembly for a latch assembly as claimed in claim 11, with the second end of the base including two spaced guides extending from and perpendicular to the second end of the base, with the two guides having a passageway therebetween through which the latching/unlatching control rod extends.

13. The assembly for a latch assembly as claimed in claim 8, with the first end of the base including a bend with a first positioning hole, with the first end of the dogging member including a second positioning hole, with each of the first and second positioning holes extending in a direction parallel to and spaced from the longitudinal axis, with the spring being a torsion spring having a first tang fixed in the first positioning hole and a second tang fixed in the second positioning hole.

14. The assembly for a latch assembly as claimed in claim 8, with the at least one arm of the dogging member including two arms located opposite to one another, and with one of the two arms being actuated by the actuating portion of the lock core when the lock core is rotated by the lock core key.

* * * * *